United States Patent [19]

Basiulis

[11] Patent Number: 4,627,487

[45] Date of Patent: Dec. 9, 1986

[54] SEPARATE LIQUID FLOW HEAT PIPE SYSTEM

[75] Inventor: Algerd Basiulis, Redondo Beach, Calif.

[73] Assignee: Hughes Aircraft Company, Los Angeles, Calif.

[21] Appl. No.: 562,916

[22] Filed: Dec. 19, 1983

[51] Int. Cl.[4] ..... F28D 15/00

[52] U.S. Cl. ..... 165/104.26; 165/104.14; 165/104.27

[58] Field of Search ..... 165/104.26, 104.14

[56] References Cited

U.S. PATENT DOCUMENTS

| | | | |
|---|---|---|---|
| 4,220,195 | 9/1980 | Bovgoyn et al. | 165/104.26 |
| 4,422,501 | 12/1983 | Franklin et al. | 165/104.26 |
| 4,470,451 | 9/1984 | Alario et al. | 165/104.26 |

*Primary Examiner*—Albert W. Davis, Jr.

*Attorney, Agent, or Firm*—Lewis B. Sternfels; A. W. Karambelas

[57] ABSTRACT

A heat pipe has a large area vapor tube for radiant heat loss and has connected thereto a subcooled liquid return tube for a return of the condensed liquid to the evaporator portion of the vapor tube. Wicking material plugs return the liquid and provide equilibrium along the length of the system. The separate return of the liquid through liquid tube permits a long heat pipe which may have several thermal connections.

6 Claims, 7 Drawing Figures

SEPARATE LIQUID FLOW HEAT PIPE SYSTEM

BACKGROUND OF THE INVENTION

1. Field of the Invention

This invention is directed to a heat pipe system wherein condensed liquid is returned to the evaporator section through a separate subcooled artery. Furthermore, the heat pipe system is arranged so that heat may move in or out of the heat pipe fluid at several locations in the system.

2. Description of the Prior Art

The management of heat includes the collection of heat, transport of the heat and rejection of waste heat. Under certain conditions, otherwise waste heat may be usefully employed by transporting the heat to the required location where heating is required. There are many different types of systems for the transport of heat, usually employing transfer of a fluid containing the heat or thermal conduction through a liquid or solid. Heat pipes are systems wherein the mass transfer of the thermal transport fluid is accomplished by the heat itself. The fluid is boiled at the location where heat is collected by the heat pipe, and the vapor is condensed at the location where the heat is rejected from the heat pipe. Liquid return has traditionally been through the same conduit which transported the vapor to the condensor. When gravity cannot be relied upon for liquid return and to otherwise control the liquid, the liquid is returned by capillary forces through a wick. The flow of liquid and vapor in opposite directions in the same tube has caused problems. Previously heat pipes have had limited capacity over long distances because of these problems. Therefore, there is need for an improved device for the transport of heat.

SUMMARY OF THE INVENTION

In order to aid in the understanding of this invention, it can be stated in essentially summary form that it is directed to a heat pipe system wherein a subcooled liquid flow tube is connected to a vapor tube to collect heat pipe liquid at the condensor and deliver it to the evaporator, to provide a liquid return pipe which is separate from the flow of vapor to the condensor. Furthermore, the vapor tube is preferably interconnected with the liquid return tube over several places along its length, particularly when the length is long. Heat may be transported into or out of the heat pipe system at any location along the length thereof.

It is thus a purpose and advantage of this invention to provide a heat pipe system wherein liquid condensing in a heat pipe is conducted away from the condensing area through a separate liquid return artery, to provide unobstructed vapor flow through a separate vapor tube to the condensing area.

It is a further purpose and advantage of this invention to provide a heat pipe system with a liquid return tube separate from the vapor tube wherein the liquid return tube is interconnected with the tube of vapor flowing toward the condensing zone to achieve thermal stability along the length of the vapor tube and liquid return tube to permit an especially long heat pipe system.

It is another purpose and advantage of this invention to provide a side-flow heat pipe system wherein heat may be delivered into and extracted out of the heat pipe at different positions along the length thereof so as to achieve a thermal management system which removes heat from where it is not desired and delivers it to locations where it is desired.

Other purposes and advantages of this invention will become apparent from a study of the following portion of this specification, the claims and the attached drawings.

DETAILED DESCRIPTION OF THE INVENTION

Figure 1:
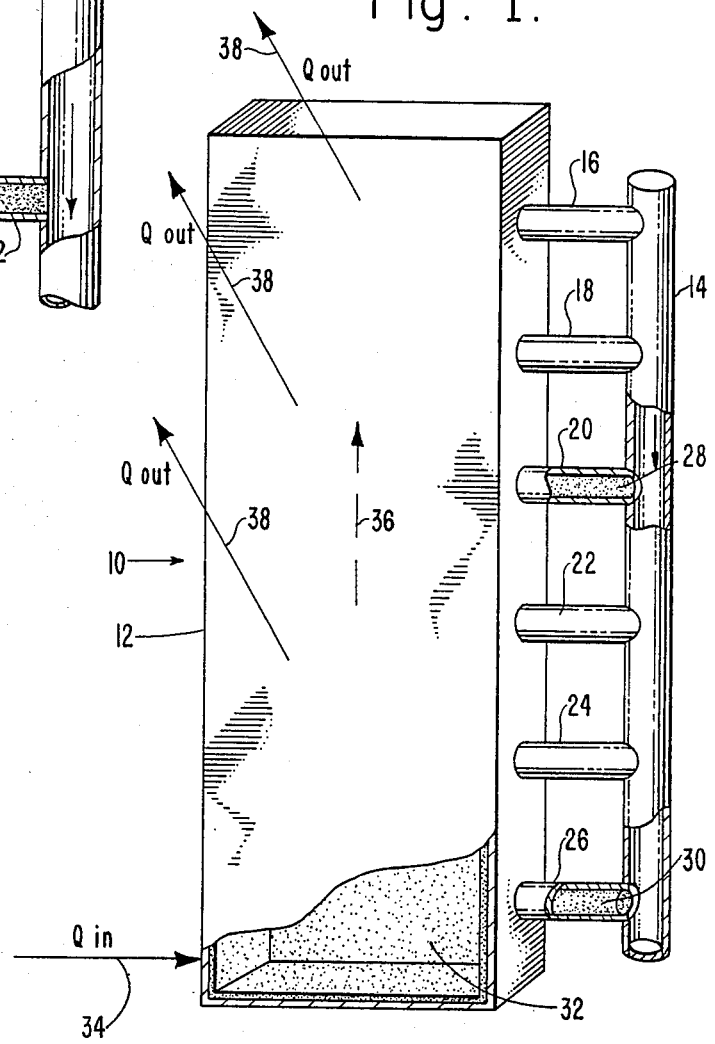
FIG. 1 is a perspective view of a first preferred embodiment of the side-flow heat pipe system of this invention, with parts broken away and parts taken in section, showing a large panel vapor tube especially suited for the radiant rejection of heat.

FIG. 1 shows a first preferred embodiment of the heat pipe system of this invention, as it is generally indicated therein at 10. Heat pipe system 10 comprises vapor tube 12 and liquid return tube 14. The vapor and liquid return tubes are connected together in a totally closed system and are interconnected by a plurality of stabilizing connectors 16, 18, 20, 22, 24 and 26. As is seen for connectors 20 and 26, they, like the other connectors, are filled with wicking material to permit liquid transfer through the stabilizing connectors. Liquid return tube 14 is separated at all connections from vapor tube 12 by separators comprising the wicking material. Wicking material 28 is indicated with respect to connector 20 and wicking material 30 is indicated with respect to connector 26. Similar wicking material 32 lines the entire interior surface of vapor tube 12. The closed system is charged with a suitable heat pipe working fluid. Methanol is a suitable working fluid for a heat rejection operating temperature range of −22° to 65° Celsius. Stainless steel is a suitable material for the structural parts, including the wicking material which is made of sintered stainless steel material.

In operation, heat pipe system 10 is charged with the working fluid and heat is delivered to the system from a heat source 34. The liquid has been delivered to wicking material 32 and this addition of heat causes boiling of the liquid to vapor. The vapor rises in vapor tube 12 as indicated by a rising vapor flow arrow 36. Throughout the exposed area of vapor tube 12, heat is radiantly extracted to a heat sink 38. The breadth of vapor tube 12 is such as to permit the vapor tube to deliver heat to the heat sink through radiant heat loss. Heat source 34 may be coupled by other means, such as a conductive mechanical connection to the face of vapor tube 12 but system 10 is particularly designed for heat rejection by means of radiation. The vapor condensing over the area of radiant heat sink 38 is collected into the wicking material on the interior of the vapor tube and is delivered through the wicking material in the stabilizing connectors, particularly connectors 16, 18 and 20, and delivered for flow in liquid return tube 14. Since the liquid return tube contains only liquid, it can be subcooled below the condensation temperature. Therefore, there is no vapor in the liquid return tube to interfere with liquid return flow. The stabilizing connectors are required along the length of the vapor tube and liquid return tube to provide the required thermal stability therebetween. Liquid can move in either direction through the wicking in the stabilizing connectors for supply to the vapor tube or for collection from the vapor tube liquid state working fluid, as required by local thermal conditions.

Figure 2:
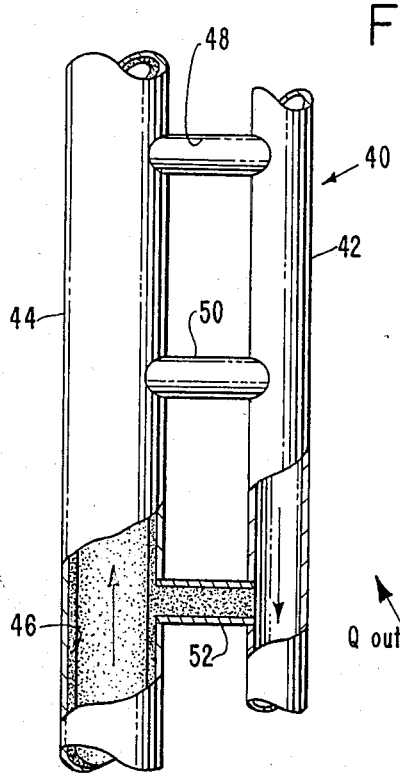
FIG. 2 is a side elevational view, with parts broken away and parts taken in section, of a second preferred embodiment of this invention, showing the separate liquid return tube, parallel and connected to the vapor tube of the heat pipe.

The basic concept of separating liquid working fluid from the vapor flowing in the opposite direction through the heat pipe system is illustrated in a sideflow heat pipe system 40 illustrated in FIG. 2. A liquid return tube 42 separates the returning liquid from the vapor passing to the condensor in a vapor tube 44. This substantially improves heat transfer capability as a result of reduction in viscous flow losses. Vapor tube 44 is lined with wicking material 46, extending substantially throughout the length of tube 44 but this wicking material is absent from liquid return tube 42. By this means, the returning liquid in tube 42 is without those viscous losses caused by flow through wicking. Tubes 42 and 44 extend in the same direction and are parallel to the direction of desired heat flow. Stabilizing interconnectors 48, 50 and 52 provide a series of smaller interconnecting channels. These connectors and all other connections are filled with the wicking material to separate the liquid and vapor passages, and continuous fluid flow is thus assured between side-flow liquid return tube 42 and wicking material 46 in the vapor tube. In FIG. 2, heat boils the liquid at the lower end of vapor tube 44, and heat rejection at the top end of vapor tube 44 condenses the working fluid so that it passes into and fills liquid return tube 42. Heat pipe system 40 is a completely closed system with a suitable heat pipe fluid therein. A preferred example for all embodiments described herein of the working fluid is methanol, and the entire structure can be made of stainless steel, including sintered stainless steel wicking material, as described above.

When charged, but before the heat load is applied, liquid return tube 42 contains saturated vapor, isolated from the wicking material structure in vapor tube 44 and in the stabilizing connectors. The vapor is at a pressure corresponding to the temperature in the liquid return tube. When a heat load is applied at the bottom of vapor tube 44, the temperature of the working fluid vapor at the heat source is elevated above the temperature of the vapor in liquid return tube 42. This raises the vapor pressure in vapor tube 44. The increase in pressure in the vapor tube drives liquid from the wicking material, and particularly the liquid in the wicking material in the stabilizing connectors, into the liquid return tube to completely fill the liquid return tube. This process is termed "Clapeyron" priming. The temperature difference between the liquid return tube and the vapor tube is established by subcooled liquid entering the liquid return tube in the region of the condensor, at the top of system 40 of FIG. 2. Additional subcooling is provided as a result of heat loss from uninsulated liquid return tube 42. This subcooling eliminates the chance of vapor bubbles in the liquid return tube from hindering liquid return to the heat source region. This structure thus provides high heat transport capacity, by means of its high liquid flow capacity, and operability is assured by the powerful priming mechanism.

Figure 3:
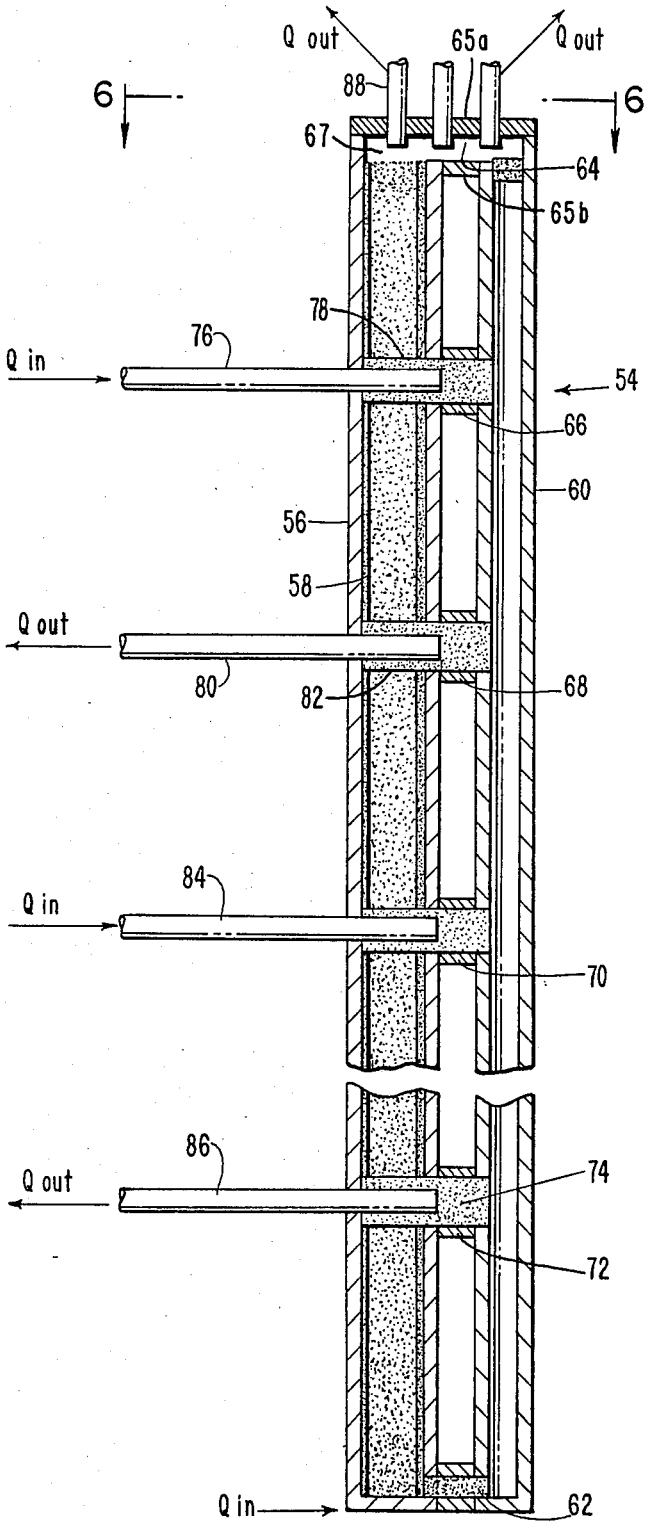
FIG. 3 is a longitudinal section through a third embodiment of the side-flow heat pipe system of this invention, showing the addition and removal of heat at several locations along the length of the heat pipe.

Systems 10 and 40 of FIGS. 1 and 2 show that a liquid return tube in parallel with a lined wicking vapor tube can provide a long heat pipe in the direction of heat flow, with substantial thermal capacity. The same type of system can be employed where there is a plurality of heat sinks and/or heat sources which can be conveniently connected together in a single thermal bus. A heat pipe system 54 is illustrated in FIG. 3 as such a bus. System 54 has a vapor tube 56 which is lined with wicking material 58 in the same manner as the other vapor tubes, that is, extending substantially in a continuous manner between the ends of the vapor tube. A liquid return tube 60 is connected to the vapor tube at each end and at stabilizing connectors intermediate the ends. At the lower, heat source end, the liquid return tube is connected to the vapor tube through a connector 62 which contains the wicking material as previously described. At the top, which is the condensor section where the heat is removed, an enclosed connector 64 with cover **65*a* and a bottom 65*b* forms an enclosed space 67 which interconnects vapor tube 56 and liquid return tube 60. Connectors 66, 68, 70 and 72 interconnect the vapor tube and liquid return tube, as previously described. These connectors each carry therein wicking material, with the wicking material particularly designated by indicium 74 in FIGS. 3 and 4**. The entire vapor tube is lined with wicking material, and the wicking material in the connectors transfers liquid to and from the vapor tube, as required to establish equilibrium.

As previously discussed, heat may be transferred into or out of system 54 at several locations along its length. As seen in FIG. 3, a heat pipe 76 of conventional single tube construction, passes into vapor tube 56 and is inserted in a plug 78 of wicking material which extends all the way across (but does not obstruct longitudinal flow in) vapor tube 56. The plug of wicking material 78 extends through connector 66 so that flow of liquid to and from the active portion of heat pipe 76 is assured. The active portion is the portion where heat pipe 76 transfers heat to or from the fluid in and around wicking material 78. A heat pipe 80 is the same as heat pipe 76 except that it is shown as extracting heat so that vapor condenses on wicking material 82, and liquid is delivered by the wicking material into liquid return tube 60. It is thus seen that these pipes 76 and 80 have separate fluid systems wherein the fluid does not exchange with the fluid in the separate, single tube heat pipe.

Figure 4:
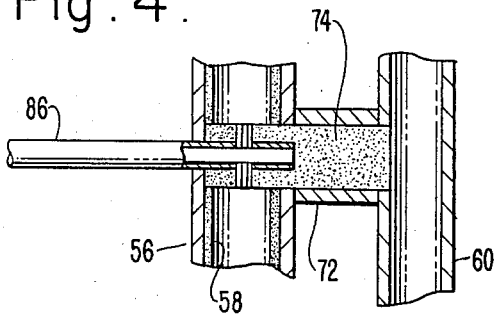
FIG. 4 is an enlarged detail of a portion of the structure of FIG. 3.
Figure 7:
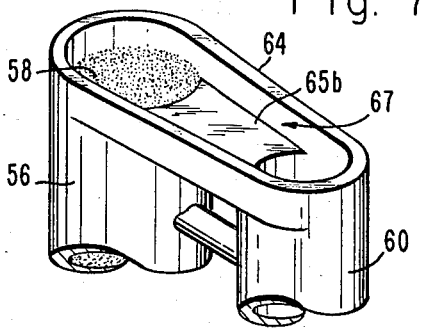
FIG. 7 is a perspective view of the upper portion of the embodiment of FIG. 3, with the closure lid removed.
Figure 6:
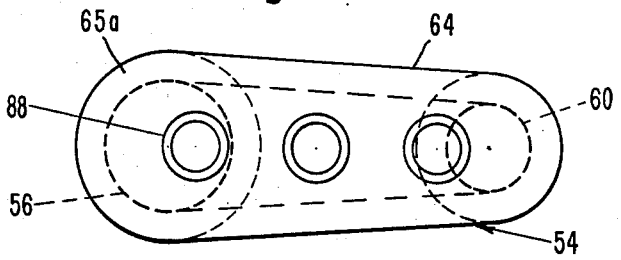
FIG. 6 is a transverse section of the embodiment of FIG. 3, taken along the line 6—6 thereof showing the condenser section.

On the other hand, heat pipes 84 and 86 are single tube heat pipes which are open to the fluid in system 60. As is seen in FIG. 4, heat pipe 86 is open on the end and the wicking on the interior of single tube heat pipe 86 is in contact with the wicking material 74 in connector 72. Thus, the heat pipe fluid in heat pipe 54 flows in and out of the secondary, single tube heat pipe 86 to transfer heat and fluid therebetween. This is satisfactory as long as the heat load served by heat pipe 86 is consistent with the fluid and fluid pressures in heat pipe 54. As is seen in FIG. 3, heat pipe 86 transfers heat out of system 54. On the other hand, heat pipe 84 is connected to a heat load which transfers heat into the main portion of system 54. Heat pipe 84 is the same as heat pipe 86. Thus, heat pipe 54 is a thermal bus which transfers heat in and out of various thermal loads. In addition, heat can be supplied to the evaporator section of vapor tube 56 and heat can be transferred out at the condensor section of at the top of vapor tube 56. When the vapor is condensed at the top, it is collected on wicking and returned to liquid return tube 60. A heat sink 88 extending from cover 65*a* at the top of system 54 may be of any convenient nature. FIGS. 3 and 6 illustrate radiator tubes. The heat may be removed at that location by convection, conduction or radiation. The heat supply at the bottom of heat pipe 54 can be used to initially prime the system, upon startup as previously described.

Figure 5:
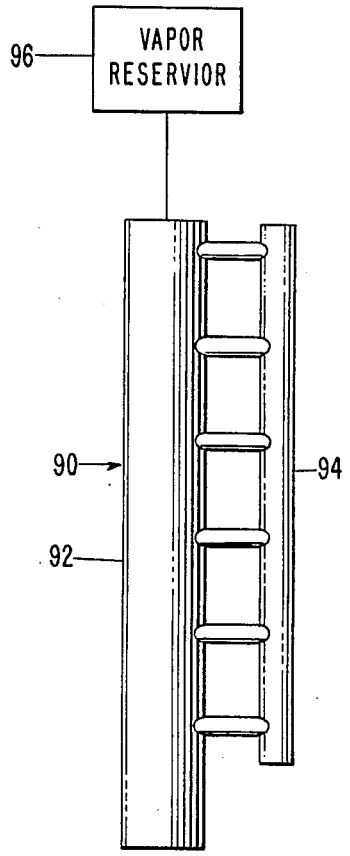
FIG. 5 is a side elevational view of a heat pipe similar to those embodiments shown in FIGS. 1 and 2, showing a separate vapor reservoir attached to the vapor tube.

A heat pipe 90, illustrated in FIG. 5, is a heat pipe which is similar to that illustrated in FIG. 2. It may have the large panel area on the vapor tube as is described with respect to heat pipe 10, and it may have a plurality of thermal connections as described with respect to heat pipe system 54. Heat pipe 90 has a vapor tube 92 and a liquid return tube 94, with the two tubes being interconnected at several locations to provide the fluid and thermal stability therebetween. The distinctive feature of heat pipe system 90 is the utilization of a vapor reservoir 96 which is connected to vapor tube 92. Vapor reservoir 96 is substantially out of the thermal loop, but is a reservoir of the same vapor as the heat pipe fluid. Vapor reservoir 96 thus stabilizes the pressure of the thermally active vapor in vapor tube 92 to help hold the temperature even. This is particularly useful when the heat pipe system is used as a thermal bus.

This invention has been described in its presently contemplated best mode and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A heat pipe system comprising:

an elongated heat pipe vapor tube extending in the direction of desired heat transfer, said vapor tube being at least partially lined with a heat pipe liquid wicking material;

a liquid return tube, said return tube being subcooled and substantially without heat pipe liquid wicking material therein;

a first connector between said liquid return tube and said vapor tube adjacent the first end thereof;

a second connector between said liquid return tube and said vapor tube adjacent the second end thereof;

at least one connector between said liquid return tube and said vapor tube between said first and second ends thereof;

heat pipe liquid wicking material filling all of said connectors so as to pass liquid to and from said liquid return tube so that said tubes are connected only through said wicking material; and a thermal connection connected to said wicking material in said intermediate connector so that heat exchange takes place within said system intermediate the ends thereof.

2. The system of claim 1 wherein a heat source is connected to said first end for supplying heat to said first end to vaporize liquid so that the vapor flows through said vapor tube towards said second end.

3. The system of claim 2 wherein a heat sink is connected to said second end to remove heat from said second end of said vapor tube to condense vapor therein into heat pipe liquid so that heat pipe liquid is delivered to said connector adjacent said second end for delivery to said liquid return tube.

4. A heat pipe system comprising:

a vapor tube having a first and a second end, said vapor tube being elongated and having heat pipe liquid wicking material over substantially the entire inner surface thereof and having a heat pipe vapor passage therethrough from said first end to said second end, said heat pipe vapor tube being positionable in the direction of desired heat flow;

thermal connection means adjacent each said first end and said second end of said vapor tube for transferring heat in and out of said vapor tube;

a first connector connected to said vapor tube adjacent said first end thereof and a second connector tube connected to said vapor tube adjacent said second end thereof;

a liquid return tube connected to said first and second connectors, said liquid return tube being subcooled and separated from said vapor tube by means of heat transfer liquid wicking material at both said first and second connectors so that heat pipe vapor in said vapor tube can not pass directly into said liquid return tube, said liquid return tube being substantially without heat pipe liquid wicking material therein, said heat pipe system being closed with respect to the ambient and said heat pipe system being for containing heat pipe fluid therein so that delivery of heat into said vapor tube adjacent said first end thereof causes vaporization of heat pipe fluid which travels through said vapor tube and transfer of heat out of said vapor tube adjacent its second end causes condensation of the vapor adjacent said second end with the resultant condensed heat pipe liquid being transferred through said connector adjacent said second end and through said wicking material in said second connector to pass through said liquid return tube to said first end;

at least one connector intermediate the first and second ends of said vapor tube, said intermediate connector being connected between said vapor and said liquid return tube and said intermediate connector having a plug of heat pipe liquid wicking material therein so as to transfer liquid to and from said liquid return tube at said intermediate connector to maintain equilibrium in said vapor tube at said connector; and intermediate thermal means connected to said vapor tube at said intermediate connector, said intermediate thermal means being connected to said wicking material at said intermediate connector so that heat transfer causes changing the phase of the heat pipe fluid at said wicking material at said intermediate connector so that said heat pipe system serves as a thermal bus serving more than one heat requirement.

5. The heat pipe system of claim 4 wherein said thermal means connected to said intermediate connector is a single tube, arterial heat pipe.

6. The heat pipe system of claim 5 wherein said single tube, arterial heat pipe connected at said intermediate connector is a closed fluid heat pipe having fluid independent of the fluid in said vapor tube.

* * * * *